United States Patent [19]

McKenna

[11] Patent Number: 4,524,709

[45] Date of Patent: Jun. 25, 1985

[54] COLLAPSIBLE WIND PROPELLED WATER CRAFT

[76] Inventor: Quentin M. McKenna, 524 Portlock Rd., Honolulu, Hi. 96825

[21] Appl. No.: 446,595

[22] Filed: Dec. 3, 1982

[51] Int. Cl.[3] ..... B63B 35/00

[52] U.S. Cl. ..... 114/39; 114/61; 114/102; 114/89; 403/217

[58] Field of Search ..... 114/39, 61, 89–91, 114/130–132, 123, 141, 283, 292, 354; 403/170–172, 176, 217, 219

[56] References Cited

U.S. PATENT DOCUMENTS

| | | | |
|---|---|---|---|
| 19,996 | 4/1858 | Joline | 114/132 |
| 831,636 | 9/1906 | Suhm . | |
| 1,642,716 | 9/1927 | Bentzen . | |
| 1,656,412 | 1/1928 | Barnhart | 114/292 |
| 2,106,209 | 1/1938 | Edge | 114/39 |
| 3,173,395 | 3/1965 | Laurent | 114/102 |
| 3,265,026 | 8/1966 | Hamilton | 114/123 |
| 3,395,664 | 7/1968 | Greenberg et al. | 114/39 |
| 3,631,828 | 1/1972 | Smith . | |
| 3,646,902 | 3/1972 | Smith . | |
| 3,691,976 | 9/1972 | Wilson . | |
| 3,827,206 | 8/1974 | Nierle | 403/170 |
| 3,831,539 | 8/1974 | Black | 114/39 |
| 3,870,004 | 3/1975 | Bailey . | |
| 3,902,443 | 9/1975 | McDougall | 114/39 |
| 3,930,562 | 1/1976 | Zorn | 114/90 |
| 3,991,694 | 11/1976 | Black . | |
| 4,056,327 | 11/1977 | Daus . | |
| 4,149,481 | 4/1979 | Leber . | |
| 4,294,184 | 10/1981 | Heinrich | 114/123 |
| 4,316,424 | 2/1982 | McKenna | 403/219 X |
| 4,326,475 | 4/1982 | Berté | 114/39 |
| 4,407,600 | 10/1983 | Thompson | 114/109 |

FOREIGN PATENT DOCUMENTS

| | | | |
|---|---|---|---|
| 693829 | 8/1965 | Italy | 114/102 |
| 560851 | 4/1944 | United Kingdom . | |

*Primary Examiner*—Trygve M. Blix
*Assistant Examiner*—Edwin L. Swinehart
*Attorney, Agent, or Firm*—Jeffers, Irish & Hoffman

[57] ABSTRACT

A collapsible wind propelled watercraft adapted for movement over water having a substantially tetrahedral frame comprising three substantially equidistantly spaced support members adapted to engage and be supported on the surface of the water, four substantially rigid spars hingedly connected together at a juncture and extending radially outwardly therefrom such that three of the spars may articulate about the fourth spar to collapse the frame, the four spars further being separated from each other by equal angles. A plurality of stays are connected between each one of the spars and the other spars at points on the spars substantially equidistant from the juncture so as to form the substantially tetrahedral frame, and three of the spars extend laterally and downwardly from the juncture and have the support members connected near their distal ends. Suspended in the area defined by the three spars and the water surface is a trampoline connected to the distal ends of the three spars extending downwardly. A pair of sails are connected to the tetrahedral frame in such a manner that they are capable of being raised or lowered, and a line arrangement connected to one of the three support members enables the craft to be steered in a desired direction.

36 Claims, 20 Drawing Figures

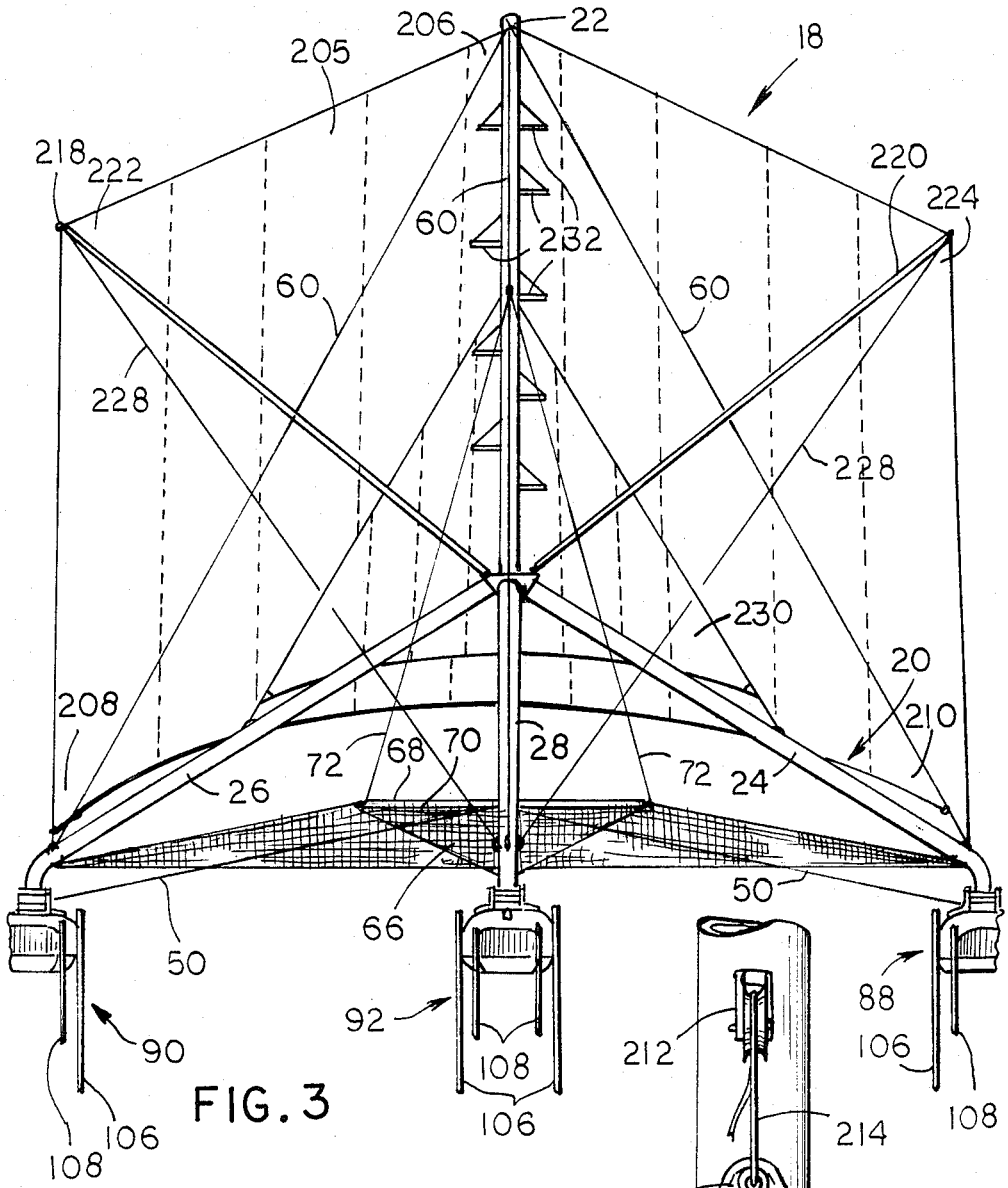
FIG. 3
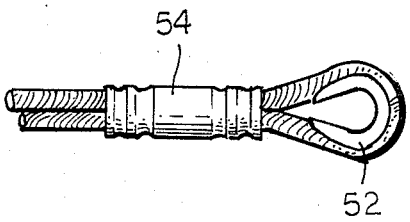
FIG. 5
FIG. 10

FIG.11
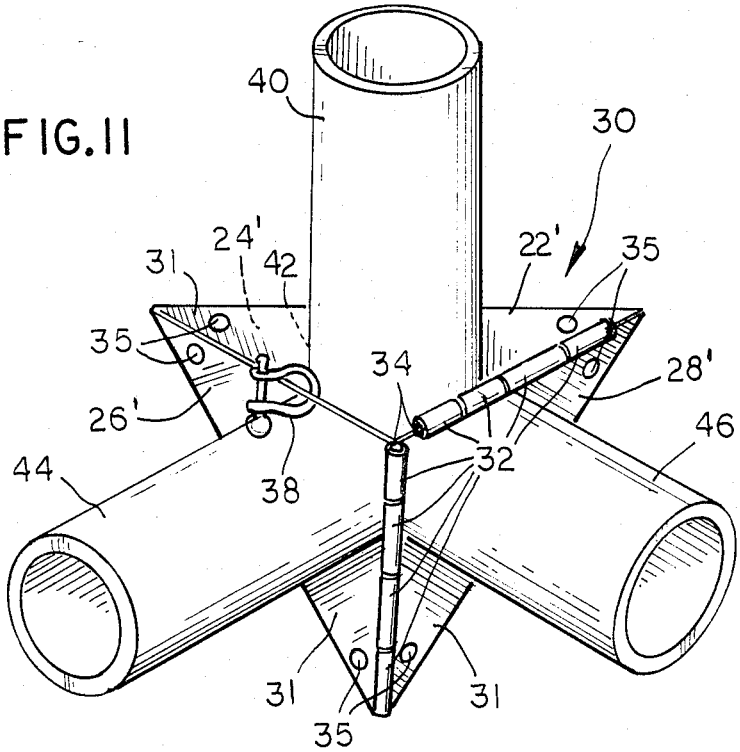
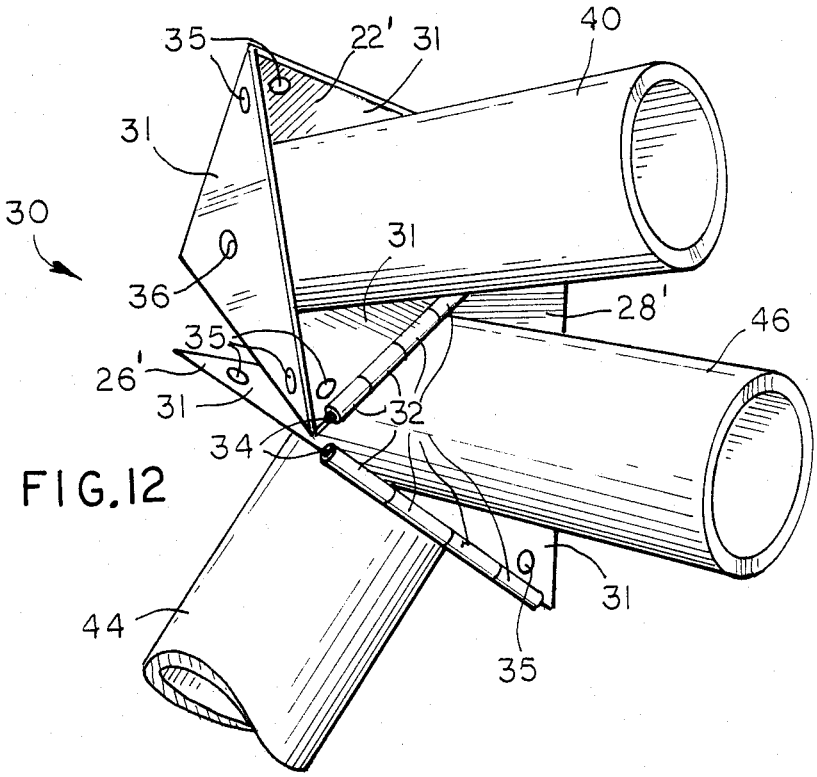
FIG.12

COLLAPSIBLE WIND PROPELLED WATER CRAFT

CROSS REFERENCE TO RELATED APPLICATIONS

This application relates generally to the type of sailing craft described in U.S. Pat. No. 4,333,412, filed Sept. 26, 1980, and U.S. Pat. No. 4,316,424, filed Jan. 2, 1980, each of which is expressly incorporated herein by reference.

BACKGROUND OF THE INVENTION

The present invention relates to a wind propelled craft, and more particularly to a collapsible wind propelled water craft.

Sailing vessels have been utilized for water travel from the time of early recorded history, and a great many designs have been developed in order to accomplish the specific objective of the sailing craft, whether it be intended for commercial usage or for pleasure. A great many factors enter into the design of a sailing craft, such as the speed which it can attain in a given wind, its stability in high winds, the amount of sail which it is able to carry in high winds, its durability, and the like.

A common design of sailing craft comprises a single hull, which is generally elongated in shape and provided with a center board or keel. One or more masts connected to the hull carry the sails, and in the case of large ocean-going commercial vessels extensively employed before the advent of steamships, an extremely complex system of masts, yardarms, stays, etc., were required to propel the large hull and cargo load carried therein. A difficulty with a one-hull vessel is that the large contact area between the hull and water results in very substantial frictional drag thereby reducing the speed of the vessel. This drag is further increased by the necessity of having a centerboard in order to prevent overturning of the vessel in high winds.

In order to reduce the frictional drag between the hull and water, multiple-hulled vessles, such as catamarans and trimarans, have been developed. In these vessels, the mast or masts and rigging are supported on a plurality of pontoons or floats, which are widely spaced from each other and which have a relatively small wetted surface when compared with a conventional single-hull vessel. Although multi-hulled vessels are capable of much higher speeds than conventional single-hulled vessels, they are much more difficult to maneuver, especially when attempting to turn into the wind. Also, because the hulls are interconnected by means of a framework of elongated, tubular members, the vessel is generally not as durable as a single-hull vessel.

In order to overcome the problems and disadvantages of prior art sailing vessel designs, the vessel according to the present invention comprises a collapsible, substantially tetrahedral frame connected to three support members adapted to float on the surface of the water, a unique framework for increased support, and a dual sail arrangement.

One prior art sailing vessel employing a rigid frame which is polyhedral in shape is disclosed in U.S. Pat. No. 3,395,664. In one embodiment, the frame comprises six interconnected tubular members defining a triangular face connected to three buoyant support members, and three triangular sides connected at an apex. In another embodiment, a lower tetrahedral frame made of similar members has a vertical mast connected to the apex thereof and is supported by a plurality of stays connected to the three corners of the triangular base. A problem with the first discussed embodiment, is that the frame relies for support solely on the six interconnected tubular members, thereby making it unsuitable for operation in high winds or rough seas. In the second embodiment, the mast is merely connected to the polyhedral frame and does not function as one of the structural members, thereby resulting in an unbalance of forces so as to substantially reduce the durability and overall strength of the vessel. Furthermore, none of the tubular members are collapsible while the craft is afloat with sails set for easy passage beneath obstacles.

U.S. Pat. No. 3,991,694 discloses a semi-rigid wind propelled vessel wherein the mast is similarly connected to the apex of a polyhedral frame and supported by a plurality of stays connected to the corners of the triangular base of the frame. Again, the stresses and forces are unequally distributed, and would not be as suitable for ocean-going use, as in the case with the vessel according to the present invention. Additionally, there is not taught a collapsible mast with sails set thereon for passage beneath obstacles.

SUMMARY OF THE INVENTION

The sailing vessel according to the present invention is designed to be lightweight yet extremely durable and strong such that it is capable of withstanding heavy seas and high winds, which are often encountered when sailing on the ocean. One of the objectives of the invention is to provide a sailing vessel which is designed for trans-oceanic voyages at very high speeds, and capable of towing or carrying larger loads at slower speeds. The same design would also be applicable to smaller pleasure craft, although such craft would be constructed on a greatly reduced scale.

The basic rigid frame is substantially tetrahedral in shape and comprises four substantially rigid spars interconnected together at a juncture and defining equal angles between them. An important aspect of the invention is that the effective lengths of the spars are equal and are retained in the proper orientation by means of stays connected to the spars at respective points equidistant from the juncture. The orientation of the spars are such that one of the spars is vertically oriented and the remaining three are laterally and downwardly oriented from the juncture. A frame constructed in this manner has stresses and forces equally distributed among the respective stays and among the respective spars. To further distribute the forces on the frame, a trampoline and rigid tube member framework is suspended by a plurality of stays in the space defined by the three spars and the surface of the water. The trampoline is substantially shaped as an equilateral triangle having its vertices connected near the distal ends of the three downwardly oriented spars. Three rigid tube members are attached to the trampoline, each one being inwardly of a respective vertex, and each has its ends connected by a plurality of stays to the distal end of a respective one of the three downwardly oriented spars and to a point on the vertical spar approximately midway between its proximal and distal ends.

Furthermore, the center of gravity is at the centroid of the tetrahedron, which is the juncture of the four rigid spars, thereby resulting in a vessel which is extremely stable and not prone to overturning, as would be the case with vessels wherein a tall vertical mast is connected to the apex of the polyhedral frame. Additional stays may be connected between the three downwardly disposed spars if desired.

Connected to the distal ends of the three spars extending laterally and downwardly from the juncture are buoyant support members, each of which include movable sideboards and skegs connected thereto. The buoyant support members are connected such that each may be horizontally rotated to provide directional control to the craft and vertically rotated to ride waves or ripples of water.

The mainsail is connected to the distal ends of the vertical and two other spars. The mainsail is unfurled and furled by drawing it upwardly and lowering it, respectively, along the vertical spar, as by means of a line and pulley block arrangement. A smaller storm sail may be mounted in a similar manner to the midpoints of the same spars such that it is located inboard of the mainsail.

A further unique feature of the present invention is the construction of the juncture. The proximal ends of the spars are constructed such that when joined together the spars extend radially outwardly therefrom at equal angles from each other. The proximal ends of the spars are formed as interconnected plates forming tetrahedrons that are hinged together such that three of the spars may articulate about the proximal end of the fourth spar, thereby allowing the water craft to be collapsed for land transport. Additionally, the orientation of the spars is such that the fourth spar about whose proximal end the three other spars articulate is one of the three spars extending laterally and downwardly from the juncture. This particular orientation of the spars will allow the vertical spar to be partially lowered to allow the water craft passage beneath low obstacles while underway.

In one form thereof, the present invention relates to a collapsible wind propelled water craft comprising three substantially equidistantly spaced support members adapted to engage and be supported on the water surface, four substantially rigid spars hingedly connected together at a juncture and extending radially outward therefrom, each of the spars forming an angle of about 110° with each of the other spars, a plurality of stays connected to and between each one of the spars and the other spars, respectively, the stays being connected to the spars at points substantially equidistant from the juncture so as to form with the spars a frame of substantially tetrahedral shape. Three of the spars extend laterally and downwardly from the juncture, and a fourth spar extends vertically upward therefrom. Suspended in the space defined by the three spars and the water surface is a triangular support means having vertices connected to the distal ends of the three downwardly, laterally oriented spars. The support members are connected to the frame at points near the distal ends of the spars extending laterally and downwardly from the juncture, and each have movable sideboards and skegs connected thereto to assist in controlling the watercraft. A sail is connected to the frame.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein:

FIG. 3 is an aft elevational view of FIG. 1;

FIG. 5 is an enlarged view of a stay end having a sleeve press swaged thereon;

FIG. 10 is an enlarged detailed view of a pulley connection between a sail and a spar;

FIG. 11 is an enlarged detailed view of the juncture of the water craft;

FIG. 12 depicts the juncture of FIG. 11 in an articulated position;

DESCRIPTION OF A PREFERRED EMBODIMENT

Figure 1:
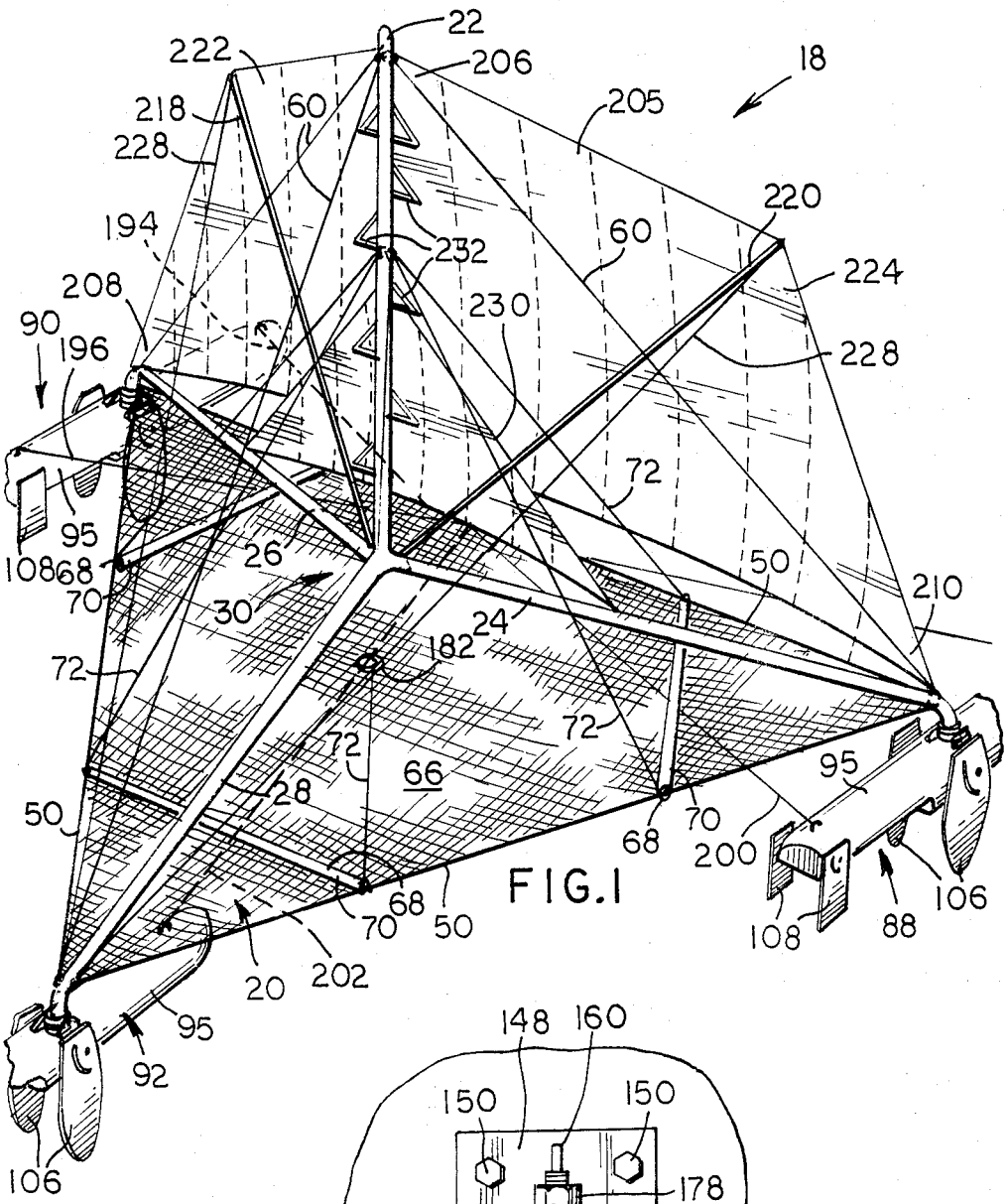
FIG. 1 is a perspective view of the wind powered water craft according to the present invention.
Figure 7:
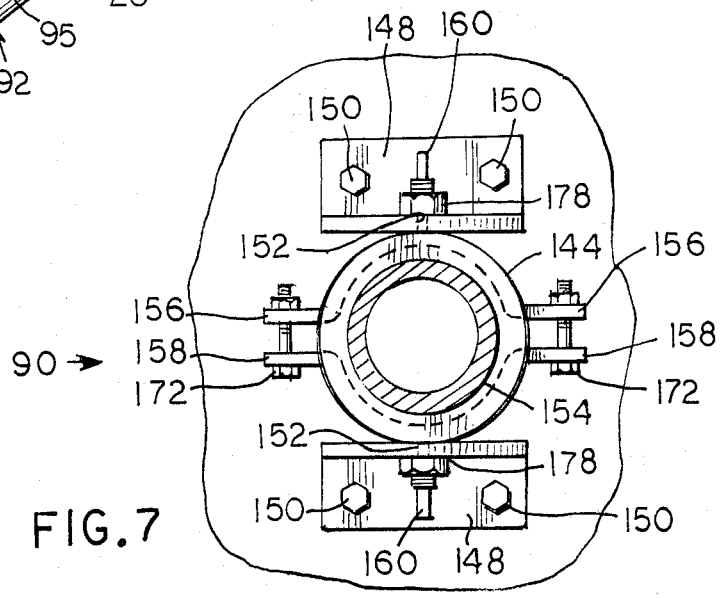
FIG. 7 is an enlarged top plan view partly broken away and in section of a pontoon.

Referring now to the figures, and in particular to FIG. 1, a water craft 18 according to the present invention is illustrated. The frame 20 of water craft 18 comprises four rigid spars 22, 24, 26 and 28, which are connected at juncture 30 such that they form angles of approximately 110° relative to one another. Hereafter, in order to make the description of the water craft 18 more easily understood, spar 22 will be designated the vertical spar, spar 24 will be designated the starboard spar, spar 26 will be designated the port spar and spar 28 will be designated the aft spar. All of the spars 22, 24, 26 and 28 are of hollow construction and made of a lightweight, strong material such as aluminum, fiberglass or the like. Also, spars 22, 24, 26 and 28 are of equal length in this embodiment, however, this is not a strict requirement of the invention and, generally, the vertical spar may be longer than the other spars so that flags or signal pennants may be flown therefrom.

Figure 13A:
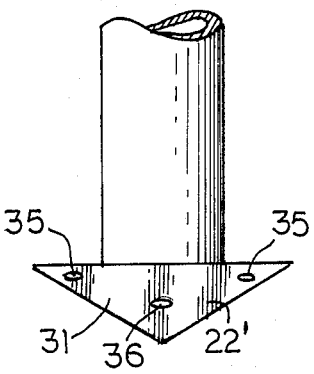
FIG. 13A is an enlarged elevational view of a proximal end of a spar.
Figure 13C:
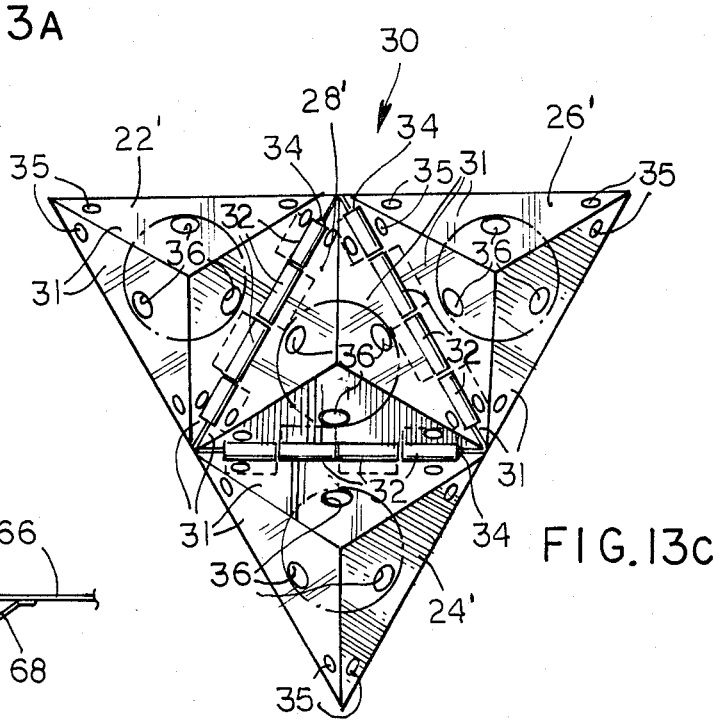
FIG. 13C is an enlarged view of the proximal ends of the spar assembly in a collapsed or open position.
Figure 16:
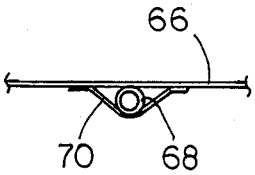
FIG. 16 is a sectional view of FIG. 2 taken along line 16—16 and viewed in the direction of the arrows.
Figure 13B:
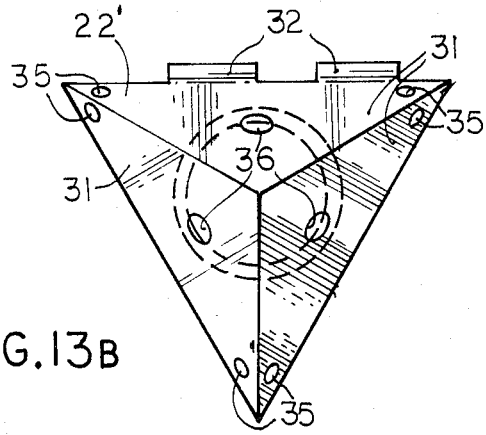
FIG. 13B is a view of FIG. 13A from the proximal end of the spar.

The construction of juncture 30 and the shape of the proximal end of spars 22, 24, 26 and 28 are unique and important to the present invention. Juncture 30 is more clearly illustrated in FIGS. 11 through 13C, and includes four tetrahedral heads 22', 24', 26' and 28'. Each head 22', 24', 26' and 28' is constructed by welding three identical isosceles triangularly-shaped faces 31 together along their respective equal sides. Each of the identical isosceles faces 31 has an apex angle of approximately 109° 28' with the remaining two equal angles being approximately 35° 16' each, and the length of the two equal sides of each face 31 is approximately $\sqrt{0.375}$ (L), where L is the length of the longest side. As illustrated in FIGS. 13B, 13C, each of the heads 22', 24', 26' and 28' has welded on one side two tube hinge members 32. Head 28' further has tube hinge members 32 on its other two sides. As the heads 22', 24', 26' and 28' are brought together to form juncture 30, tube hinge members 32 interfit with each other as depicted in FIG. 13C. Three pins 34 are then individually received through respective interfitting tube hinge members 32. Tube hinge members 32 are positioned in a staggered fashion and are of such a width that upon the juncture 30 being formed, the interfitting tube hinge members 32 form a generally solid single hinge. This particular construction of tube hinge members 32 is especially suited to counteract any moment forces against pins 34 thereby preventing their failure under prolonged stresses.

Each of the faces 31 of the four heads 22', 24', 26' and 28' are provided with two holes 35 and one hole 36 (FIG. 13C), and, when juncture 30 is formed, a hole 35 or 36 becomes aligned with a respective hole 35 or 36 of an adjacent face 31. A dee shackle 38 (FIG. 11), preferably a RONSTAN RF 616, is then received through each of the aligned pairs of holes 36. This further secures heads 22', 24', 26', 28' together and provides additional attachment points for various lines.

Referring to FIGS. 11 and 12, heads 22', 24', 26', 28' have sleeve extensions 40, 42, 44 and 46, respectively, extending outwardly therefrom. As can be seen in FIG. 11, each of the heads 22', 24', 26', 28' has its respective sleeve extension 40, 42, 44, 46 welded thereto, and the heads 22', 24', 26' 28' are hinged together as described above. The proximal ends of spars 22, 24, 26, 28 are received in respective sleeve members 40, 42, 44, 46 and secured therein an any convenient manner such as by welding, screws, or the like.

Figure 8:
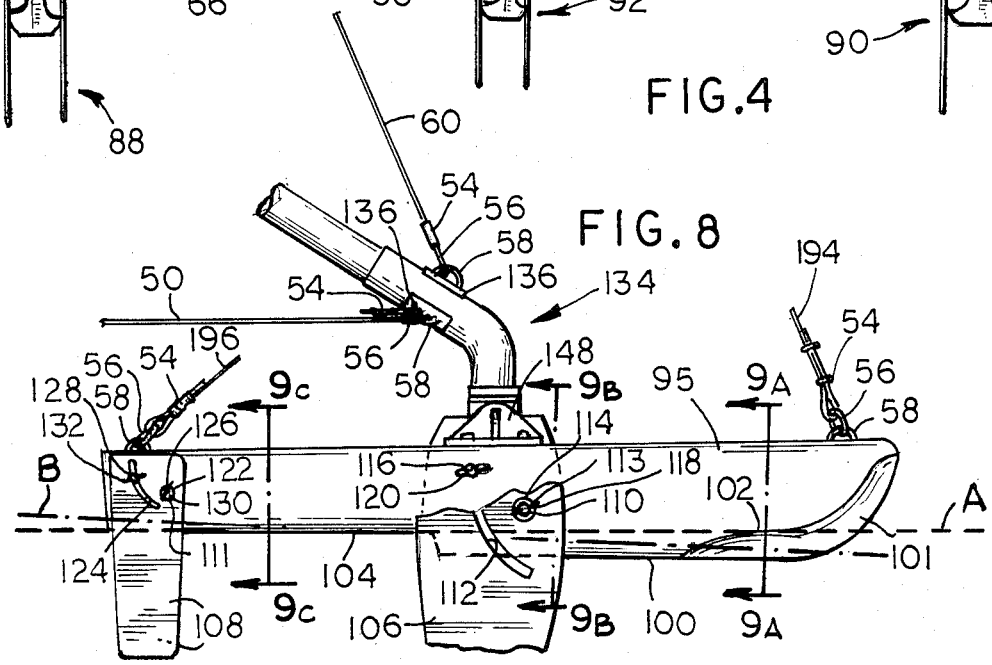
FIG. 8 is an enlarged side elevational view of a pontoon.

Three primary stays 50 (FIGS. 1–4) are connected between the respective distal ends of the starboard spar, port spar and aft spar. Each of the stays 50 has its ends formed by looping an end about a line eye 52 (FIG. 5) and then securing it to a portion of a stay 50 by, preferably, a NICRO press swaged sleeve 54 (FIG. 5). The ends so formed of stays 50 are connected to respective distal ends of the aft spar, starboard spar, and port spar (FIG. 8) by attaching them with snap rings 56 to pulley clips 58, preferably RONSTAN RF 1054, secured to the distal ends (FIG. 8). Other nautically suitable connections may be made without departing from the scope of the present invention.

Stays 60 (FIGS. 1, 3, 4, 8) connect the distal end of the vertical spar to the respective distal ends of the starboard spar, port spar, and aft spar. The connection of stays 60 between the distal end of the vertical spar and respective distal ends of the starboard, aft and port spars may be made in a manner similar to which stays 50 are connected to distal ends of the starboard, port and aft spars. Also, turnbuckles (not shown) may be attached or fitted to stays 50 and 60. It is important to note at this point that stays 50 and 60 are connected to respective distal ends of spars 22, 24, 26, 28 at points equidistant from juncture 30 so that a frame of substantially equilateral tetrahedral shape is formed.

As described so far, the structural integrity of the basic frame 20 is complete. Stays 50 and 60 are made taut by turning respective turnbuckles to remove any slack. Frame 20 balances any forces against it in a manner similar to that of applicant's craft in U.S. Pat. No. 4,316,424, filed Jan. 2, 1980 , as a result of the substantially tetrahedral shape of frame 20. Because spars 22, 24, 26, 28 are each angularly disposed at an angle of about 110° to one another and because their distal ends are interconnected by taut, flexible stays 50, 60 lateral forces projected against the frame 20 will be transformed by the structure into compressional forces down spars 22, 24, 26, 28 to juncture 30 where the forces are absorbed and dissipated by the faces 31 of the proximal ends of the spars.

Continuing to refer to FIGS. 1–4, and 16, the manner of supporting occupants and cargo on water craft 18 will be described. The support is provided by trampoline 66 having substantially the shape of an equilateral triangle. Trampoline 66 is connected to the distal ends of the port, starboard, and aft spars by other snap rings 56 attached to the vertices of trampoline 66. The snap rings 56 are then connected to respective pulley clips 58 on the distal ends of respective spars 24, 26, 28. Trampoline 66 may be made of canvas or other suitable lightweight, flexible material.

Figure 2:
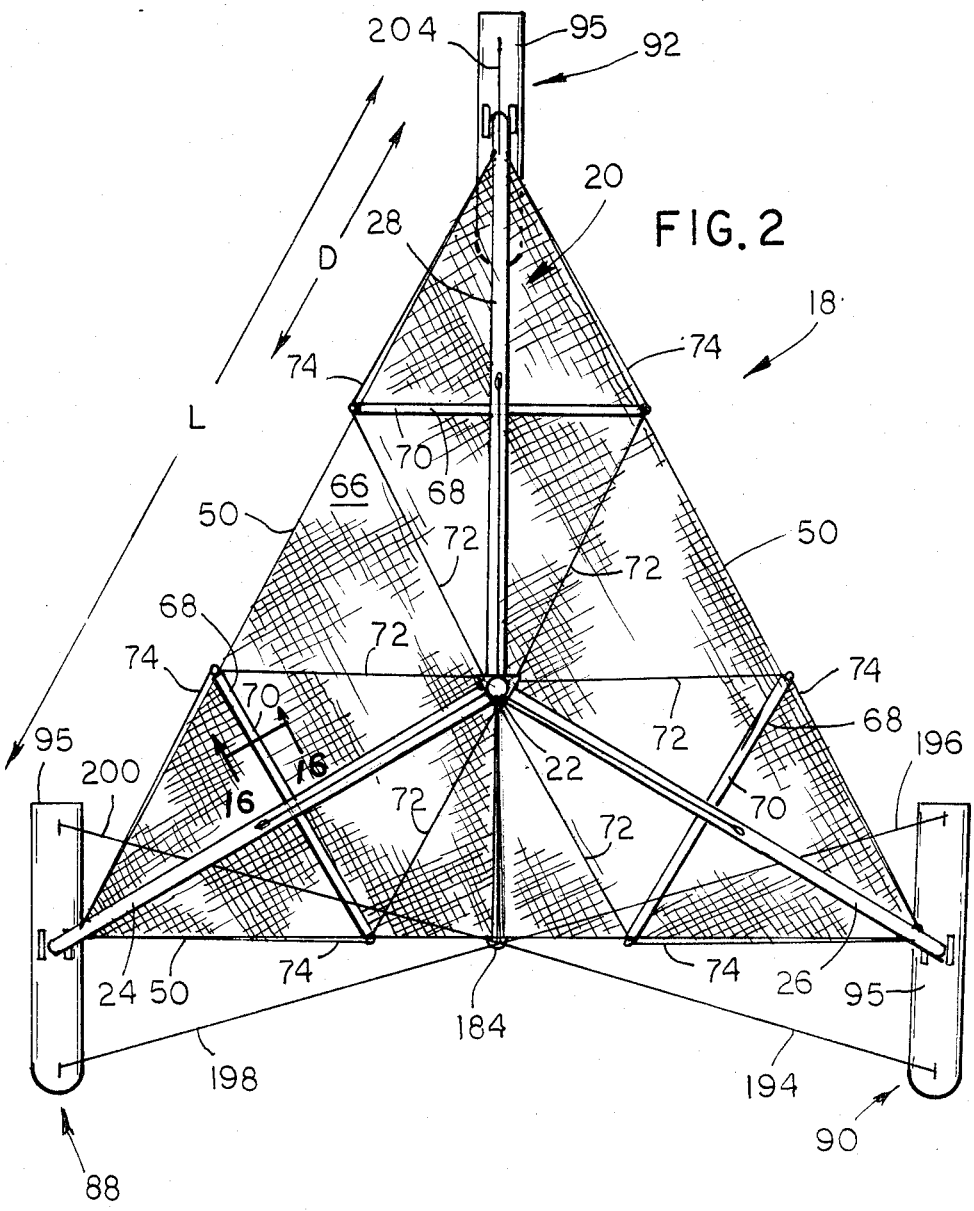
FIG. 2 is a top plan view of FIG. 1 with the sails and the spar steps removed.
Figure 9C:
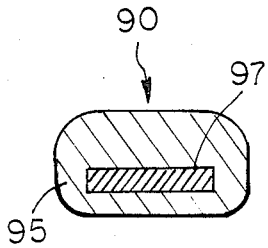
FIG. 9C is a sectional view similar to FIG. 9A taken along line 9C—9C in FIG. 8 and viewed in the direction of the arrows.
Figure 9B:
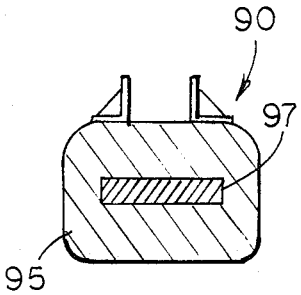
FIG. 9B is a sectional view similar to FIG. 9A taken along line 9B—9B in FIG. 8 and viewed in the direction of the arrows.
Figure 9A:
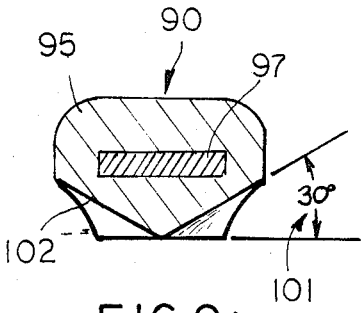
FIG. 9A, is a sectional view of the hull body of the pontoon of FIG. 8 taken along line 9A—9A and viewed in the direction of the arrows.
Figure 4:
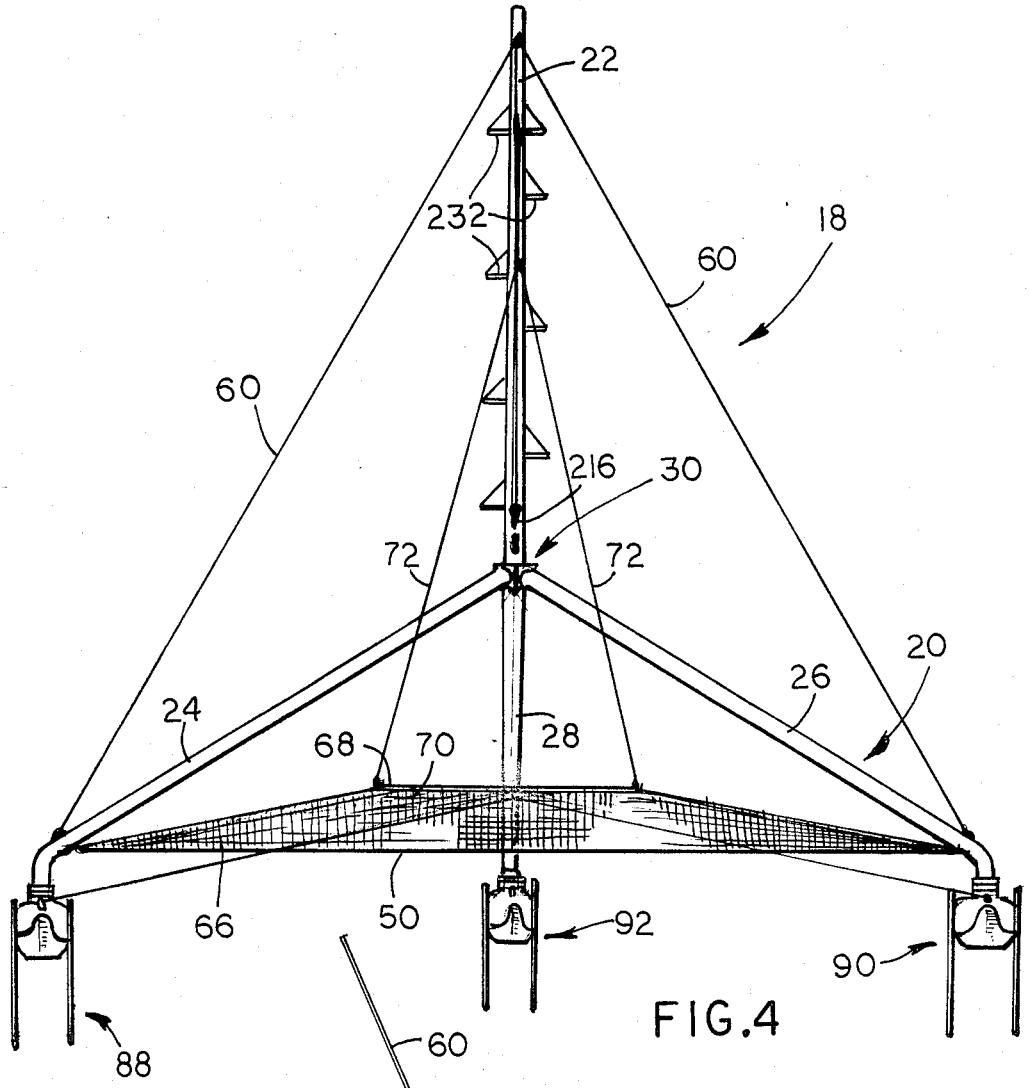
FIG. 4 is a front elevational view with the sails removed.

Three rigid tubes 68 are received in respective sleeves 70 (FIG. 16) attached to the underside of trampoline 66. Each sleeve 70 is disposed beneath trampoline 66 so that each end of a sleeve 70 terminates at a point on a respective edge of trampoline 66 about one-third the length of the respective edge from a distal end of a respective spar 24, 26, 28 (FIG. 2), i.e., distance D is approximately equal to one-third of L (FIG. 2). Tubes 68 are received in respective sleeves 70 with their ends extending outwardly beyond trampoline 66 a predetermined distance. Sleeves 70 may be made of the same material as trampoline 66 and may be sewn or otherwise secured to trampoline 66, and tubes 68 may be made of the same material as spars 22, 24, 26, 28.

A plurality of stays 72 (FIGS. 1–2) are connected between the extended ends of tubes 68 that project outwardly beyond trampoline 66 and a point approximately midway on vertical spar 22. The connections of the ends of stays 72 to vertical spar 22 may be the same as the connections between stays 50 and the distal ends of respective spars 24, 26, 28 to include turnbuckles for tensioning purposes. The opposite ends of stays 72 are secured around respective ends of tubes 68 in a suitably nautical manner.

Another plurality of stays 74 (FIG. 2) connect the extended ends of tubes 68 to the distal end of the nearest one of spars 24, 26, 28. The connection between ends of stays 74 and the distal end of the nearest one of spars 24, 26, 28 may be similar to the connections between stays 50 and the distal ends of respective spars 24, 26, 28 to include turnbuckles for tensioning purposes. As with stays 72, the opposite ends of stays 74 are secured around respective ends of tubes 68 in a suitably nautical manner.

Adjusting the turnbuckles of stays 72 and 74 permits the operator to vary the tension or rigidity of trampoline 66 to compensate for added weight on trampoline 66. For example, should extra cargo or passengers be placed on trampoline 66, thereby causing it to be lowered nearer to the water surface, tightening stays 72 and 74 by turning their respective turnbuckles will elevate trampoline 66 to a desired height above the water surface. Reversing the above procedure will compensate for reducing the load or weight on trampoline 66.

Referring now to FIGS. 1–4, 6–9C, 15, the pontoons of water craft 18 will be described. The pontoons comprise a starboard pontoon 88, a port pontoon 90, and an aft pontoon 92. Pontoons 88, 90, 92 are identical to one another and therefore a description of port pontoon 90 will suffice for a description of the other two. Pontoon 90 (FIGS. 9A–9C) has a generally cylindrical body 95, and may be made of a lightweight plastic material such as styrofoam or a structural foam molded around a wood plank 97. Also, pontoon 90 may be foam-filled with a fiberglass skin. The bow of pontoon 90 curves downwardly and inwardly to bottom surface 100 (FIG. 8) such that a deadrise 101 (FIG. 9A) of approximately 30° is created. The deadrise 101 is cut into the bow such that the deadrise edge 102 (FIG. 9A) has a length equal to the radius of the cylinder from which body 95 is fashioned. Pontoon 90 further has a step-in surface 104 (FIG. 8) along the aft portion of bottom surface 100, which allows pontoon 90 to plane with the water surface as the speed of water craft 18 increases. FIG. 8 shows the float waterline A of pontoon 90 at rest and the planing waterline B of pontoon 90 in motion.

Referring to FIGS. 1, 3, 8, a pair of sideboards 106 and a pair of skegs 108 are slidably connected to pontoons 88, 90, 92, but only pontoon 90 will be described regarding the connections thereto. Each sideboard 106 (FIG. 8) has a hole 110 and a curved slot 112 disposed therein such that upon placing sideboards 106 against pontoon 90, as shown in FIG. 8, respective holes 110 and respective slots 112 are aligned. Pontoon 90 has a bore (not shown) transversely disposed therein for receiving a metal tube 113, e.g., aluminum, therein. The metal tube 113 absorbs or dissipates compression loadings received from threaded shaft 114 received therethrough.

In a similar manner, there is also provided threaded shaft 116, which is aft and above shaft 114.

Sideboards 106 are then placed against respective sides of pontoon 90 so that the ends of shafts 114, 116 are received through holes 110 and slots 112, respectively. Locknuts 118 are then threadedly received on the ends of shaft 114, and wing nuts 120 are likewise received on shaft 116.

As described, each sideboard 106 may be adjusted by loosening a respective wing nut 120, rotating the sideboard 106 to the desired position, and tightening wing nut 120. Shaft 114 is the center of a circle having a portion of its circumference peripherally aligned with curved slot 112.

In a manner similar to sideboards 106, skegs 108 are connected to the aft portion of pontoon 90 by means of a bore, a metal tube 111, holes 122, curved slots 124, threaded shafts 126, 128, lock nuts 130, and wing nuts 132. Skegs 108 are also similarly adjustable.

Sideboards 106 and skegs 108 increase the planing efficiency of pontoons 88, 90, 92 by containing the spray generated by the planing action and thereby increase the lift factors of pontoons 88, 90, 92.

Referring to FIGS. 6, 7, 8, 15, an aluminum cast elbow joint 134 is connected to the distal end of the port spar by nut and bolt assemblies 136 received through respective aligned holes 138, 140 (FIG. 6) in elbow joint 134 and the port spar, and the respective holes in pulley clip 58. Pulley clip 58 is disposed on the uppermost portion of elbow joint 134 and additional like pulley clips 58 are angularly disposed about elbow joint 134 at angles of approximately 120°. The lower half of elbow joint 134 is angularly disposed from the upper half, which is attached to the port spar, by an angle of approximately 70.5°, and has on its end portion an upper flange 144 (FIGS. 6, 15), which may be integral to elbow joint 134, and a threaded end portion 146. Pontoon 90 has two brackets 148 secured to its top surface by screws 150, and each bracket 148 has a hole 152 horizontally disposed therein.

Figure 15:
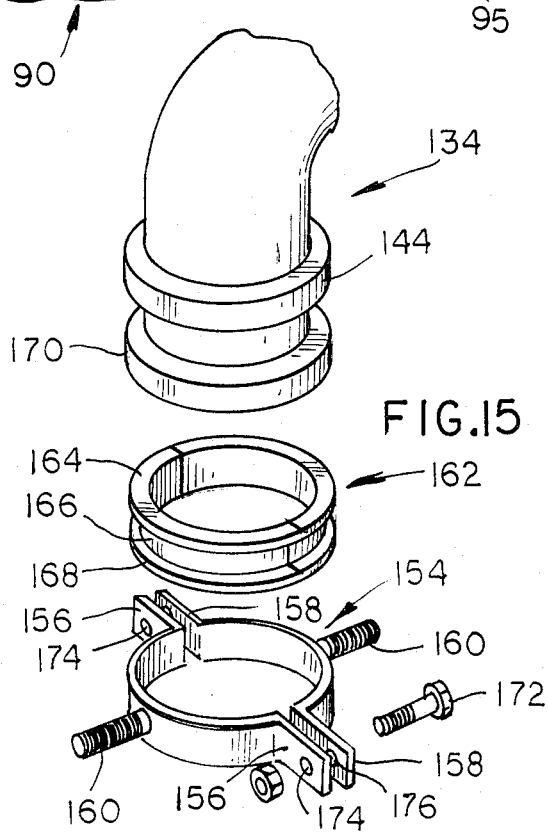
FIG. 15 is an exploded view of an elbow joint connecting a pontoon to a spar.

Referring particularly to FIG. 15, split stainless steel annulus 154 has a pair of flanges 156, 158 and a pair of threaded shafts 160. As illustrated, each of the threaded shafts 160 is diametrically opposed from the other, and each pair of flanges 156, 158 are likewise disposed and generally perpendicular to the common longitudinal axis of shafts 160. Initially, each half of split annulus 154 is positioned between brackets 148 so that a respective threaded shaft 160 is received through a respective bracket hole 152. A nylon bushing 162 comprising a separate top flange 164, cylindrical midportion 166, and a bottom flange 168 is generally positioned between elbow joint 134 and brackets 148. Prior to positioning the lower portion of elbow joint 134 within split annulus 154, top flange 164 and midportion 166 of bushing 162 are received on the lower portion of elbow joint 134 adjacent upper flange 144. The lower portion of elbow joint 134, which now has top flange 164 and midportion 166 thereon, is received within split annulus 154 and the bottom flange 168 of bushing 162 is received on elbow joint 134 adjacent midportion 166 and secured thereto by lower flange 170 of elbow joint 134 being threadedly secured to threaded end portion 146. Completion of securing pontoon 90 to the port spar is accomplished by tightening nut and bolt assemblies 172 received through holes 174, 176 of flanges 156, 158, respectively, and tightening lock nuts 178 to respective threaded shafts 160. Note that annulus 154 is disposed about midportion 166 and between flanges 164, 168.

As described, brackets 148 and threaded shafts 160 of split annulus 154 permit pontoon 90 to rock back and forth under wave action, and split annulus 154 and nylon bushing 162 disposed between flanges 144, 170 permit pontoon 90 to be horizontally pivoted to provide directional control to water craft 18.

If, prior to sailing water craft 18, it is anticipated that strong wave actions or currents may exist, nylon washers 180 (FIG. 6) may be received on respective threaded shafts 160 between split annulus 154 and brackets 148.

In an alternate embodiment, lower flange 170 may be integral to the lower portion of elbow joint 134, and nylon bushing 162 may be formed in two halves along a plane intersecting the longitudinal axis of bushing 162. The attachment of pontoon 90 to the port spar would be accomplished by fitting the two halves of nylon bushing 162 about elbow joint 134 between flanges 144, 170 and then securing split annulus 154 about bushing 162 between top flange 164 and bottom flange 168. The final connection between pontoon 90 and the port spar would then be made by removing one bracket 148 so that threaded shafts 160 may be received through respective holes 152. Thereafter, the removed bracket 148 would be resecured to pontoon 90 by screws 150 and lock nuts 178 threadedly secured to respective threaded shafts 160.

Referring to FIGS. 1, 2 and 8, the manner of positioning pontoons 88, 90, 92 to provide directional control to water craft 18 will be explained. Trampoline 66 has a grommet 182 at its geometric center, and a ring 184 is secured, e.g., by a line clip, to the midpoint of stay 50 extending between the distal ends of the port and starboard spars.

Pontoon 90 has a bow line 194 and stern line 196 connected to its bow and stern portions, respectively, each of the lines 194, 196 being secured to pontoon 90 by a respective pulley clip 58, snap ring 56, and sleeve 54 (FIG. 8). Bow line 194 and stern line 196 are then passed through ring 184 and upwardly through grommet 182 to be tie-hitched or cleated to spar 26. In a similar manner, bow line 198 and stern line 200 (FIG. 2) of starboard pontoon 88 are received through ring 184 and grommet 182. Aft pontoon 92 has bow line 202 (FIG. 1) and stern line 204 (FIG. 2) connected thereto in a manner identical to the bow lines and stern lines of pontoons 88 and 90, however, lines 202, 204 pass under trampoline 66 to be received through grommet 182 and secured to the aft spar.

To position either pontoon 88, 90, 92 to the port or starboard, the respective bow and stern lines are taken in and let out so that the pontoon may be turned in the desired direction. After slacking and taking in the appropriate lines, they are secured to their respective spar.

Referring now to FIGS. 1–4 and 10, the sail arrangement of water craft 18 will be described. A mainsail 205, generally pentagonal in shape, has its top vertex 206 and bottom two vertices 208, 210 connected to respective distal ends of spars 22, 26, 24 in any nautically suitable manner, e.g., by snap rings and pulley clips. Sail 205 is raised and lowered by means of pulley 212 (FIG. 10) connected to the distal end of spar 22 and a line 214 attached to vertex 206. Line 214 is received through pulley 212 and secured to a turnbuckle or horn cleat 216 (FIG. 4) connected at the proximal end of spar 22. The sail area of sail 205 may be increased by a factor of approximately two-fifths (2/5ths) by use of extension spars 218, 220. An end of each spar 218, 220 is connected to juncture 30, and the opposite ends of spars 218, 220 are connected to side vertices 222, 224 of sail 205 (FIG. 3). Lines 228 (FIG. 1) are attached to the respective opposite ends of spars 218, 220 and removably connected to the aft spar, by horn cleats for example, to provide means for taking in or letting out sail 205.

Generally parallel to and inboard of mainsail 205 is a smaller storm sail 230 (FIG. 3), which is connected to the midpoints of spars 22, 24, 26 in a manner similar to the connection of sail 205 to spars 22, 24, 26. Storm sail 230 is raised and lowered in a manner similar to sail 205, i.e., by use of a pulley line and horn cleat.

Due to the placement of sails 205, 230 in the forward field of view of the occupant, it may be desirable that transparent windows in sails 205, 230, or transparent sails, be provided.

Assistance in properly rigging water craft 18 and for other general requirements in sailing water craft 18 is provided by staggered steps 232 (FIGS. 1, 4) mounted on spar 22. Steps 232 are mounted such that the plane containing the port steps and the plane containing the starboard steps are angled backwardly toward the aft spar. This substantially prevents any possibility of sails 205, 230 or any lines becoming entangled with steps 232 during the sailing of water craft 18 or during the intentional collapsing of craft 18.

To navigate water craft 18, either or both of the sails 205, 230 may be raised depending on the amount of wind. As water craft 18 begins to move over the water surface, directional control is possible by adjusting the headings of pontoons 88, 90, 92 as earlier described.

Figure 14:
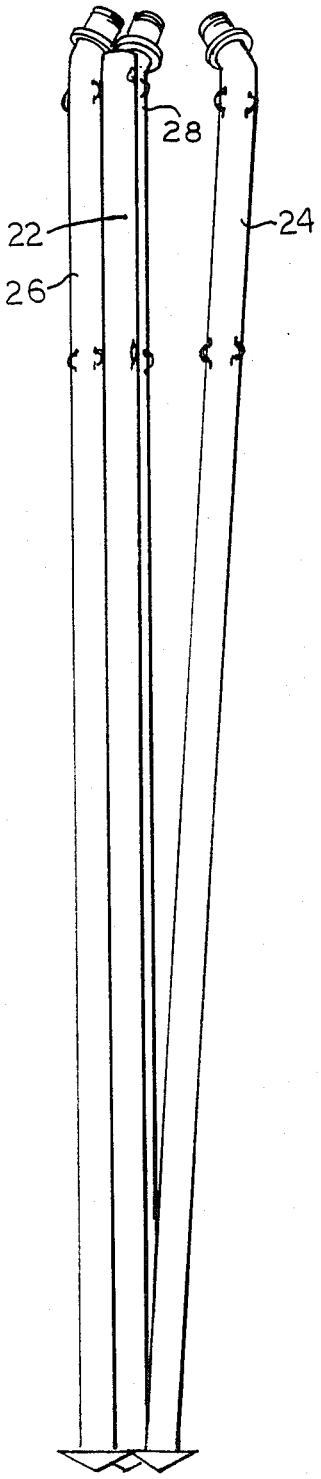
FIG. 14 depicts the frame of the water craft in a collapsed position with the sails and pontoons removed.
Figure 6:
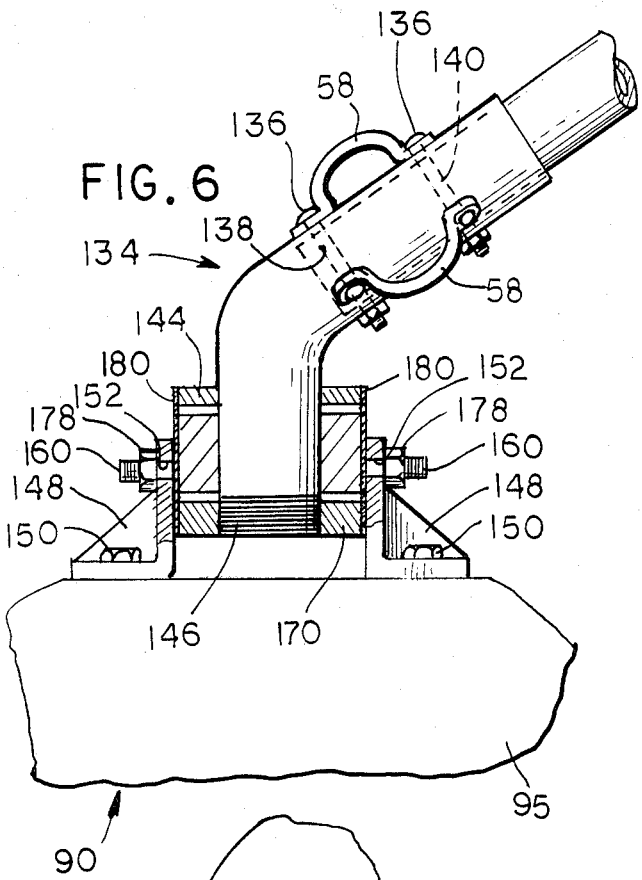
FIG. 6 is an enlarged detailed view partly broken away and in section of a pontoon.

If land transport of water craft 18 is desired, the frame may be easily collapsed by slacking stays and then articulating the vertical spar, starboard spar, and port spar about the proximal end of the aft spar. If desired, pontoons 88, 90, 92 may be removed from spars 24, 26, 28. The frame 20 in its folded position appears in FIG. 14.

While this invention has been described as having a preferred embodiment, it will be understood that it is capable of further modification. This application is, therefore, intended to cover any variations, uses or adaptations of the invention following the general principles thereof and including such departures from the present disclosure as come within known or customary practice in the art to which this invention pertains and fall within the limits of the appended claims.

What is claimed is:

1. A wind propelled water craft comprising:

three spaced apart support members adapted to engage and be supported on the surface of the water, a substantially tetrahedral frame comprising four substantially rigid spars connected together at a juncture and extending radially outwardly therefrom, said spars having ends distal from said juncture, and a first plurality of taut, flexible stays connected to and between each one of said spars and the other said spars, respectively, said stays being connected to said spars at points near the distal ends thereof, three of said spars extending laterally and downwardly from said juncture and the fourth one of said spars extending vertically upward from said juncture, said fourth spar lying along a vertical axis, said support members being connected to said tetrahedral frame at points near said distal ends of said three spars, a sail connected to said tetrahedral frame, and a triangularly-shaped trampoline having its three vertices connected near said distal ends of said three spars, and a tensioning means comprising three sleeve members, each said sleeve member being connected to said trampoline near a respective said vertex, and three rigid tube members, each said rigid tube member being received in a respective said sleeve member, each of said rigid tube members having a second plurality of taut, flexible stays connecting its end portions to the said fourth vertical spar.

2. The craft of claim 1 wherein said four spars are of equal length, are connected at their proximal ends, and are interconnected by said stays at connection points substantially equidistant from their respective said proximal ends.

3. The craft of claim 2 wherein said sail has vertices connected to respective distal ends of said vertical spar and two of said three spars, and including a second generally triangular sail generally parallel to and inboard of said first mentioned said and having its vertices connected at respective points on said vertical spar and said two spars, said points being between said distal and proximal ends of respective said spars.

4. The craft of claim 3 including first means for moving an upper portion of said second sail upwardly or downwardly along said vertical spar.

5. The craft of claim 1 wherein said sail is connected to respective distal ends of said vertical spar and two of said three spars.

6. The craft of claim 5 including second means for moving an upper portion of said sail upwardly or downwardly along said vertical spar.

7. The craft of claim 1 further including a third plurality of taut, flexible stays connecting said end portions of each of said tube members to said fourth spar.

8. The craft of claim 1 wherein each of said support members is cylindrical in shape and has a deadrise in a forward portion thereof and a step-in surface in an aft portion of a bottom surface thereof.

9. The craft of claim 8 including means pivotably connecting said support members to respective said three spars for allowing limited rotation about generally horizontal axes, whereby said support members are maintained substantially parallel to and in contact with the water surface independently of the pitch of said water craft.

10. The craft of claim 8 wherein at least one of said support members includes a pair of generally vertically disposed sideboards slidably connected thereto, said sideboards being individually adjustable between respective first positions wherein said sideboards are above the water surface and respective second positions wherein respective portions of said sideboards are disposed below the water surface, and means for controlling the heading of said one support member on the water surface.

11. The craft of claim 10 wherein said one support member includes a pair of generally vertically disposed skegs slidably connected to an aft portion thereof, said skegs being individually adjustable between respective first positions wherein said skegs are above the water surface and respective second positions wherein respective portions of said skegs are disposed below the water surface.

12. The craft of claim 1 wherein said juncture comprises four shaped members, each of said shaped members having the form of three faces of a tetrahedron, and wherein each of said spars have a proximal end secured to the inner surface of a respective said shaped member, whereby said faces of said spars interfit with each other to form a generally solid assembly at said juncture.

13. The craft of claim 12 wherein each of said shaped members have the form of the three isosceles-shaped triangular faces of a tetrahedron having an equilaterally-shaped triangular base, the two equal angles of each said isosceles-shaped triangular face being approximately 35° 16′.

14. The craft of claim 12 wherein three of said proximal ends are hingedly connected to the fourth said proximal end, whereby said three proximal ends may articulate about said fourth proximal end when certain of said stays are slacked to thereby allow said water craft to be collapsible for land transport.

15. The craft of claim 1 further including means pivotably connecting said support members to respective said three spars for permitting limited rotation about generally horizontal axes, whereby said support members are maintained substantially parallel to and in contact with the water surface independently of the pitch of said water craft.

16. The craft of claim 1 wherein said spars form angles of about 110° with respect to each other, and said first plurality of stays are connected to the respective spars at points substantially equidistant from said juncture.

17. A collapsible wind propelled craft adapted to move over a water surface comprising:

three substantially rigid spars connected together at a juncture and extending generally laterally and downwardly therefrom, each of said spars forming an angle of about 110° with each of the other said spars and with a vertical axis passing upwardly through said juncture, said spars having ends distal from said juncture, three substantially equidistantly spaced support members connected at points near said distal ends of said three spars to support said craft on the water surface, a first plurality of substantially equal length taut, flexible stays connected to and between each one of said three spars and the other said spars, respectively, said stays being connected to said three spars at points substantially equidistant from said juncture, a fourth spar vertically disposed upwardly from said juncture, a second plurality of taut, flexible stays connected from said distal ends of said three spars to said fourth spar at a point which is a distance from said juncture substantially equal to the distance of said points of said three spars from said juncture, three triangular plate members being connected to the proximal end of each of said spars, said three triangular plate members of a respective said spar being connected together such that they form three faces of a tetrahedron on said proximal end of a respective said spar, said four tetrahedrons converging at said juncture and interfitting with each other such that each said face of one of said tetrahedrons is in facing arrangement with a respective said face of another one of said tetrahedrons, means for hingedly connecting three of said tetrahedrons to the fourth tetrahedron so that said three tetrahedrons and their respective said spars may articulate about said fourth tetrahedron when certain of said stays are slacked, and a sail connected to said craft.

18. The craft of claim 17 wherein said sail has portions thereof connected to respective distal ends of said fourth spar and two of said three spars.

19. The craft of claim 17 including means for moving an upper portion of said sail upwardly or downwardly along said fourth spar.

20. The craft of claim 17 including a triangularly-shaped trampoline connected between said three spars, and a third plurality of taut, flexible stays having respective ones of their ends connected to said fourth spar and respective opposite ends connected to side edges of said trampoline.

21. The craft of claim 20 further including means interconnected between said distal ends of said three spars and said trampoline for tensioning said trampoline therebetween.

22. The craft of claim 17 including means attached to said support members for controlling the direction of said craft.

23. A wind propelled water craft comprising:

three spaced apart support members adapted to float on the surface of the water, a substantially tetrahedral frame comprising four substantially rigid spars connected together at a juncture and extending radially outwardly therefrom, said spars having ends distal from said juncture, and a plurality of taut, flexible stays connected to and between each one of said spars and the other said spars, three of said spars extending generally laterally and downwardly from said juncture and the fourth said spar extending upwardly from said juncture, first means for rotatably connecting each of said three support members to a respective one of said three laterally, downwardly extending spars for rotation about a respective generally horizontal axis, whereby said support members may pitch with the water surface independently of said frame, said first connecting means comprising a distal end portion of a respective said spar being generally downwardly disposed, a pair of generally horizontally disposed shafts extending radially outwardly from said distal end portion, and a pair of spaced apart bracket members attached to and upstanding from a respective said support member, each said bracket member having therein a generally horizontally disposed hole for rotatably receiving therethrough a remote end portion of a respective said shaft, second means for rotatably connecting at least one of said support members to its respective said spar for rotation about a generally vertical axis, whereby said one support member may turn on the water surface independently of said frame, said second connecting means comprising a pair of vertically spaced apart flanges extending radially outwardly from said spar distal end portion to which said one support member is connected, and a collar member being rotatably disposed on said distal end portion between said flanges and having said shafts of said first connecting means of said one support member joined thereto, whereby said one support member may pitch with and turn on the water surface independently of said frame, and a sail connected to said frame.

24. The craft of claim 23 wherein said support members are substantially elongate in shape, and at least one of said support members has a pair of generally vertically disposed side boards adjustably connected thereto, said side boards being individually adjustable to any one of a plurality of positions between respective first positions wherein said side boards are above the water surface and respective said positions wherein respective portions of said side boards are disposed below the water surface.

25. The craft of claim 24 wherein each of said sideboards is rotatably connected to a respective end portion of a first shaft member generally horizontally, transversely disposed through said one support member, said sideboards having therein respective aligned curved slots wherein each said curved slot is a peripheral portion of a circle having its center at a respective end of said first shaft member, said curved slots receiving therethrough respective threaded end portions of a second shaft member, said threaded end portions having respective threaded nuts removably secured thereon to secure respective said sideboards in their positions, whereby said sideboards may be individually adjusted by loosening a respective said threaded nut, rotating a respective said sideboard about its respective said first shaft end portion to a desired position, and then tightening said respective threaded nut.

26. The craft of claim 24 further including a pair of generally vertically disposed skegs adjustably connected to said one support member aft of said sideboards, said skegs being individually adjustable to any one of a plurality of positions between respective first positions wherein said skegs are above the water surface and respective second positions wherein respective portions of said skegs are disposed below the water surface.

27. The craft of claim 26 wherein each of said skegs is rotatably connected to a respective end portion of a third shaft member generally horizontally, transversely disposed through said one support member, said skegs having therein respective aligned curved slots wherein each said curved slot is a peripheral portion of a circle having its center at a respective end of said third shaft member, said curved slots receiving therethrough respective threaded end portions of a fourth shaft member, said threaded end portions having respective threaded nuts removably secured thereon to secure respective said skegs in their positions, whereby said skegs may be individually adjusted by loosening a respective said threaded nut, rotating a respective said skeg about its respective said third shaft end portion to a desired position, and then tightening said respective threaded nut.

28. The craft of claim 27 wherein each of said sideboards is rotatably connected to a respective end portion of a first shaft member generally horizontally, transversely disposed through said one support member, said sideboards having therein respective aligned curved slots wherein each said curved slot is a peripheral portion of a circle having its center at a respective end of said first shaft member, said curved slots receiving therethrough respective threaded end portions of a second shaft member, said threaded end portions having respective threaded nuts removably secured thereon to secure respective said sideboards in their positions, whereby said sideboards may be individually adjusted by loosening a respective said threaded nut, rotating a respective said sideboard about its respective said first shaft end portion to a desired position, and then tightening said respective threaded nut.

29. The craft of claim 28 further including a bow line having one end portion connected to a bow section of said one support member, a stern line having one end portion connected to an aft section of said one support member, and means connectable to said frame and having the respective opposite end portions of said bow and stern lines removably secured thereto for selectively adjusting the respective lengths of said bow and stern lines, whereby the heading of said one support member may be selectively controlled by letting out one of said bow line and said stern line and taking in the other of said bow line and said stern line to thereby provide directional control to said craft.

30. The craft of claim 23 further including a bow line having one end portion connected to a bow section of said one support member, a stern line having one end portion connected to an aft section of said one support member, and means connectable to said frame and having the respective end portions of said bow and stern lines removably secured thereto for selectively adjusting the respective lengths of said bow and stern lines, whereby said one support member may be selectively turned on the water surface by letting out one of said bow line and stern line and taking in the other of said bow line and said stern line to thereby control the direction of said craft.

31. The craft of claim 23 further including a plurality of step members disposed on said fourth spar to provide access along the length of said fourth spar.

32. A collapsible water craft comprising:

four substantially rigid spars joined together at a juncture and extending radially outwardly therefrom, each of said spars forming an angle of about 110° with each of the other said spars to form a substantially tetrahedral frame, three of said spars extending laterally and downwardly from said juncture and the fourth said spar extending vertically upwardly from said juncture, three substantially equidistantly spaced support members connected at respective points near the distal ends of said three spars to support said frame on the water surface, a plurality of taut, flexible stays connected to and between each one of said spars and the other said spars, respectively, said stays being connected to said four spars at points substantially equidistant from said juncture, three triangular plate members being connected to the proximal end of each of said spars, said three triangular plate members of a respective said spar being connected together such that they form three faces of a tetrahedron on said proximal end of a respective said spar, said four tetrahedrons converging at said juncture and interfitting with each other such that each said face of one of said tetrahedrons is in facing arrangement with a respective said face of another one of said tetrahedrons, and means for hingedly connecting three of said tetrahedrons to the fourth tetrahedron so that said three tetrahedrons and their respective said spars may articulate about said fourth tetrahedron when certain of said stays are slacked.

33. The craft of claim 32 wherein said plate members are of isosceles shape, each said plate member having two interior angles both equal to approximately 35° 16′ and the third interior angle equal to approximately 109° 28′, each one of said three plate members of a respective said spar having one of its equal length edges joined to a respective equal length edge of another one of said three plate members by a hinge.

34. The craft of claim 33 wherein each one of said three joined triangular plate members is connected to a respective said spar by a sleeve member having one end received within a respective said tetrahedron and secured to the respective three plate members and its opposite end secured to said spar.

35. The craft of claim 32 further including a vertically movable sail being connected to said frame.

36. The craft of claim 32 wherein the sides of said plate members opposite the sides in facing arrangement with another said tetrahedron define four recesses in said juncture in which said spars are received and rigidly anchored.

* * * * *